US005385133A

United States Patent [19]

Ikuta et al.

[11] Patent Number: 5,385,133

[45] Date of Patent: Jan. 31, 1995

[54] FUEL INJECTION SYSTEM FOR INTERNAL COMBUSTION ENGINE

[75] Inventors: Kenji Ikuta, Rolling Hills Estates, Calif.; Shigenori Isomura, Kariya; Toshihiro Suzumura, Nagoya, both of Japan

[73] Assignee: Nippondenso Co., Ltd., Kariya, Japan

[21] Appl. No.: 166,380

[22] Filed: Dec. 14, 1993

[51] Int. Cl.[6] ..... F02M 69/00

[52] U.S. Cl. ..... 123/585; 123/531

[58] Field of Search ..... 123/583, 586, 587, 588, 123/531

[56] References Cited

U.S. PATENT DOCUMENTS

| | | | |
|---|---|---|---|
| 4,475,505 | 10/1984 | Hasegawa et al. | 123/585 |
| 5,086,667 | 2/1992 | Katayama et al. | 123/585 |
| 5,148,788 | 9/1992 | Saikalis et al. . | |
| 5,170,761 | 12/1992 | Kato et al. | 123/585 |
| 5,211,148 | 5/1993 | Furuya et al. | 123/585 |
| 5,255,658 | 10/1993 | Hoffer et al. | 123/531 |

FOREIGN PATENT DOCUMENTS 57-54624 11/1982 Japan .

*Primary Examiner*—Tony M. Argenbright
*Assistant Examiner*—M. Macy
*Attorney, Agent, or Firm*—Cushman, Darby & Cushman

[57] ABSTRACT

A fuel injection system for a multi-cylinder internal combustion engine is provided. This fuel injection system includes a plurality of fuel injection valves each arranged to inject fuel into an intake port of each cylinder of the engine, an air passage connected to a portion of an air intake passage leading to the intake ports, a plurality of branch air passages each communicating with a preselected portion around an injection nozzle of each fuel injection valve, an air control valve, connecting between the air passage and the plurality of branch air passages, for selectively introducing a portion of intake air in the air intake passage to the preselected portions around the injection nozzles of the fuel injection valves. The air control valve is arranged to selectively assume first and second valve positions, the first valve position being to establish communications between the air passage and the branch air passages in sequence according to rotation of the engine, the second valve position being to establish communication between the air passage and all the branch air passages to supply the intake air in the air passage uniformly to all the branch air passages when an opening period of time during which one of the fuel injection valves is open partly overlaps with that of another fuel injection valve.

8 Claims, 6 Drawing Sheets

FUEL INJECTION SYSTEM FOR INTERNAL COMBUSTION ENGINE

BACKGROUND OF THE INVENTION

1. Technical Field of the Invention

The present invention relates generally to a fuel injection system for an internal combustion engine. More particularly, the invention is directed to a fuel injection system which is operable to regulate the amount of intake air introduced from a portion of an intake passage upstream of a throttle valve to a fuel injection valve provided for each cylinder and the timing where the intake air introduced is ejected to the fuel injection valve for optimizing atomization of the fuel injected from the fuel injection valve over a wide range of engine operation.

2. Background Art

Japanese Patent Second Publication No. 57-54624 teaches an improved fuel injection system which includes an air control valve arranged to introduce a portion of intake air, substantially under the atmospheric pressure, upstream of a throttle valve installed in an intake air passage to an injection nozzle of a fuel injection valve through an air passage bypassing the intake air passage. The air control valve is opened in synchronization with an operation of the fuel injection valve when the throttle valve is somewhat closed, so that the portion of the intake air is ejected around the injection nozzle to mix with the fuel injected by the fuel injection valve for promoting atomization of the injected fuel.

With the above arrangement, even when a flow velocity of the intake air in an intake port of the engine is relatively low such as during idle modes of engine operation, the fuel injected from the fuel injection valve becomes atomized sufficiently, thereby improving combustion conditions of air/fuel mixtures in a combustion chamber of the engine to reduce the amount of harmful emission products such as hydrocarbons (HC) or carbon monoxide (CO) remaining in exhaust gases. In the following discussion, the air mixing means, as mentioned above, will be referred to as timing-controlled air mixture system.

In order to meet emission regulations of automotive internal combustion engines which have become more severe in recent years, an individual injection type of fuel injection system including a fuel injection valve for each cylinder of a multi-cylinder engine, has been put to practical use. In a combination of the timing-controlled air mixture system and the individual injection type of fuel injection system, there has been proposed a single air control valve which is arranged to distribute a portion of the intake air to the fuel injection valves mounted in intake ports of cylinders of the engine through intake air passages, respectively bypassing an intake air passage leading to the intake ports, according to ignition timing of each cylinder, e.g., at each cycle of 180° crank angle in case of a four-cylinder engine.

Such a conventional air control valve of the timing-controlled air mixture system, however, encounters a drawback for the following reasons. When starting the engine at a relatively low ambient temperature, for example, below 0° C. it is necessary to increase an injection period of time a fuel injection valve is open in excess of a crank angle of 180° for assuring stable ignition since the volatility of fuel will be degraded according to a decrease in temperature in the engine. Therefore, when the engine starts at a lower temperature, in a portion of the injection period of time beyond a crank angle of 180° , the intake air is not supplied to the fuel injection valves through the air control valve, thereby causing the degree of atomization of the fuel injected from the fuel injection valves to be reduced greatly. This results in harmful emission products remaining in exhaust gases being increased undesirably.

SUMMARY OF THE INVENTION

It is therefore a principal object of the present invention to avoid the disadvantages of the prior art.

It is another object of the present invention to provide a fuel injection system which is operable to regulate the amount of intake air introduced from a portion of an intake passage upstream of a throttle valve to a fuel injection valve provided for each cylinder and the timing where the intake air introduced is ejected to the fuel injection valves for optimizing atomization of the fuel injected from the fuel injection valves over a wide range of engine operation.

According to one aspect of the present invention, there is provided a fuel injection system for a multi-cylinder internal combustion engine which comprises a plurality of fuel injection valves each arranged to inject fuel into an intake port of each cylinder of the engine, an air passage connected to a portion of an air intake passage leading to the intake ports, a plurality of branch air passages each communicating with a preselected portion around an injection nozzle of each fuel injection valve, an air control valve means, connecting between the air passage and the plurality of branch air passages, for selectively introducing a portion of intake air in the air intake passage to the preselected portions around the injection nozzles of the fuel injection valves, the air control valve means being arranged to selectively assume first and second valve positions, the first valve position being to establish communications between the air passage and the branch air passages in sequence according to rotation of the engine, the second valve position being to establish communication between the air passage and all the branch air passages, and a controlling means for providing a control signal to the air control valve means to switch from the first valve position to the second valve position when a preselected fuel injecting condition is encountered.

In the preferred mode, the air control valve means includes a rotary member which is arranged to rotate with respect to a rotational axis thereof to establish the first valve position where the air passage communicates with the branch air passages in sequence according to the rotation of the engine and to move in a direction parallel to the rotational axis to establish the second valve position where the air passage communicates with all the branch air passages. The controlling means provides the control signal to the air control valve means to move the rotary member in the direction parallel to the rotational axis when a fuel injection mount greater than a preselected value is required.

In addition, the air control valve means includes an actuator which is responsive to the control signal from the controlling means to shift a rotatable shaft connected to the rotary member in the direction parallel to the rotational axis of the rotary member for assuming the second valve position when an opening period of time the fuel injection valves are open becomes longer than a preselected value.

The air control valve further includes a housing which has a plurality of first openings connected to the branch air passages, respectively and a second opening connected to the air passage. The rotary member includes an opening which is arranged to establish coincidence with at least one of the branch air passages according to the rotation of the engine in the first valve position. The rotary member is shifted in the direction parallel to the rotational axis of the rotary member so that the opening moves out of the coincidence with all the branch air passages in the second valve position.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
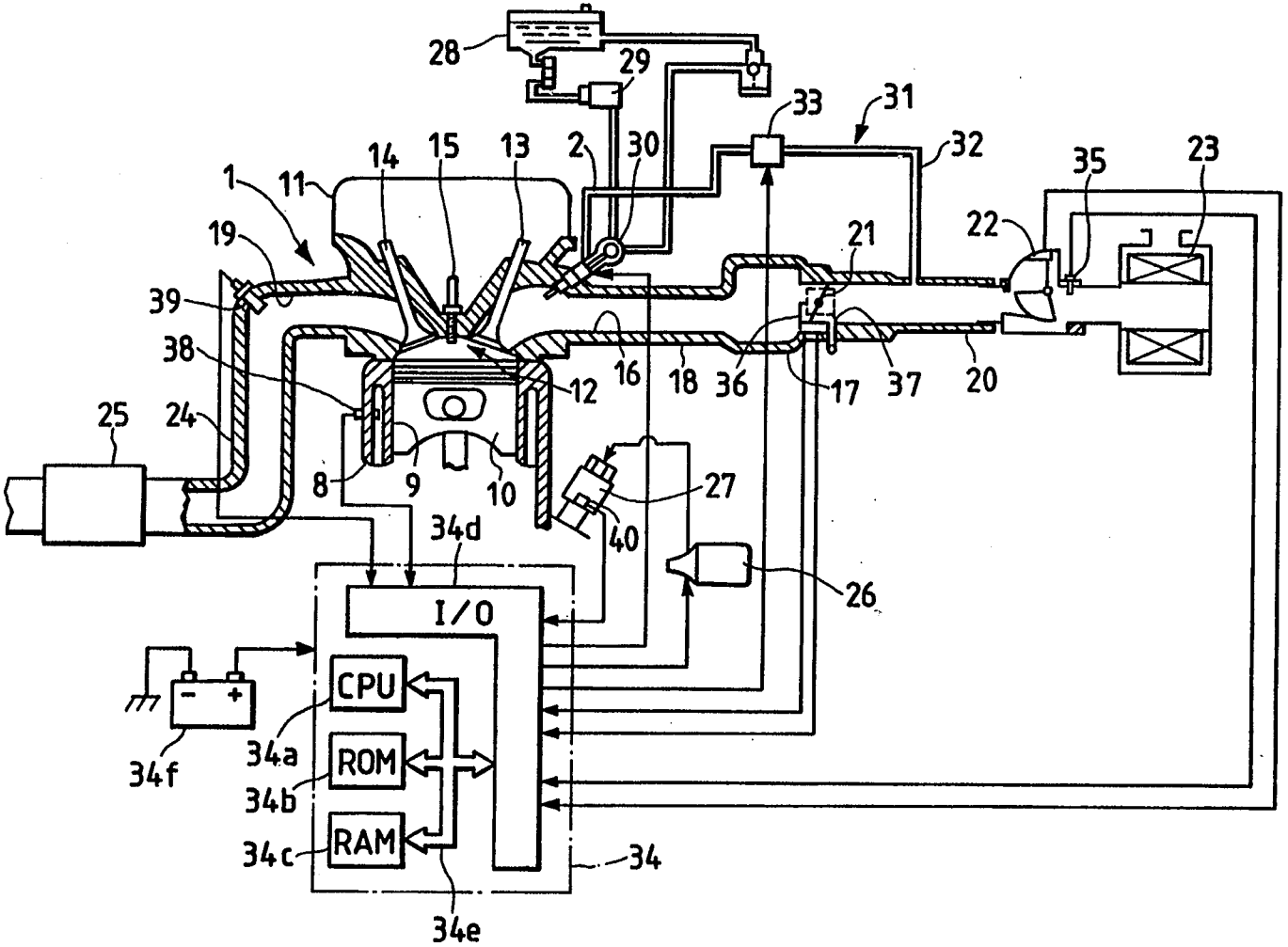
FIG. 1 is a schematic diagram which shows the entire structure of a fuel injection system for a multi-cylinder internal combustion engine according to the present invention.

Referring now to the drawings, wherein like numbers refer to like parts in several views, particularly to FIG. 1, there is shown the entire structure of a fuel injection system for a multi-cylinder internal combustion engine according to the present invention.

The multi-cylinder internal combustion engine 1 has a plurality of cylinders 9 (only one is shown) each including a piston 10, a combustion chamber 12 defined in a cylinder head 11, an intake valve 13, an exhaust valve 14, a spark plug 15, an intake port 16 leading to the combustion chamber 12 through the intake valve 13, an intake pipe 18 branched from a surge tank 17, communicating with the intake valve 13, and an exhaust port 19 communicating with the combustion chamber 12 through the exhaust valve 14.

In an air intake passage 20 upstream of the surge tank 17, a throttle valve 21, an airflow meter 22, and an air cleaner 23 are arranged. The exhaust port 19 of each cylinder 9 is connected to a common exhaust pipe 24 leading to a catalytic converter 25 which purges exhaust gases. The ignition system of the engine includes an igniter 26 providing a high voltage required for producing ignition sparks at the respective spark plugs 15 and a distributor 27 for intermittently distributing the high voltage generated by the igniter 26 to the spark plug 15 of each cylinder according to the speed of a crank shaft (not shown) of the engine 1.

The fuel supply system of the engine includes a fuel tank 28, a fuel pump 29 for pressurizing fuel to a desired injection pressure level, and solenoid-operated fuel injection valves 30, each disposed in the intake port 16, which open an injection nozzle upon energization thereof. The timing-controlled air mixture system 31 of the fuel injection system includes an air mixture line 32, an air control valve 33, and the fuel injection valves 30. The air mixture line 32 opens into a portion of the air intake passage 20 upstream of the throttle valve 21. The air control valve 33 is constructed to distribute the air introduced through the air mixture line 32 to branch air mixture lines *2a*, *2b*, *2c*, and *2d* (as will be generally denoted at numeral 2) leading to the cylinders, respectively.

The fuel injection system further includes an electronic control unit (ECU) 34, an intake air temperature sensor 35, a throttle position sensor 36, an idling switch 37, a coolant temperature sensor 38, an oxygen sensor 39, and a rotational angle sensor 40. The intake air temperature sensor 35 is disposed within the airflow meter 22 for measuring the temperature of intake air and provides a signal indicative thereof to the ECU 34. The throttle position sensor 36 detects an opening degree of the throttle valve 21 to provide a signal indicative thereof to the ECU 34. The idling switch 37 detects fully closed position of the throttle valve 21 and provides a signal indicative thereof to the ECU 34. The coolant temperature sensor 38 is arranged in a water jacket of the cylinder block 8 to determine the temperature of coolant and sends a signal representative thereof to the ECU 34. The oxygen sensor 39 is mounted in the exhaust pipe 24 to measure the concentration of residual oxygen in an exhaust gas and provides a signal indicative thereof to the ECU 34. The rotational angle sensor 40 is in the form of a speed sensor which produces a rotational angle indicative pulse signal per 1/24 rotation of a camshaft for driving the distributor 27, i.e., per 30° in crank angle. The ECU 34 includes a CPU **34*a* formed with a microprocessor, a ROM 34*b*, a RAM 34*c*, an input/output interface 34*d*, and a common bus 34*e* connecting these. The ECU 34 is responsive to the signals from the above sensors and switch to control the air mixture system 31 according to a given program of operation. A power source or battery 34*f* is provided for the ECU 34**.

Figure 2:
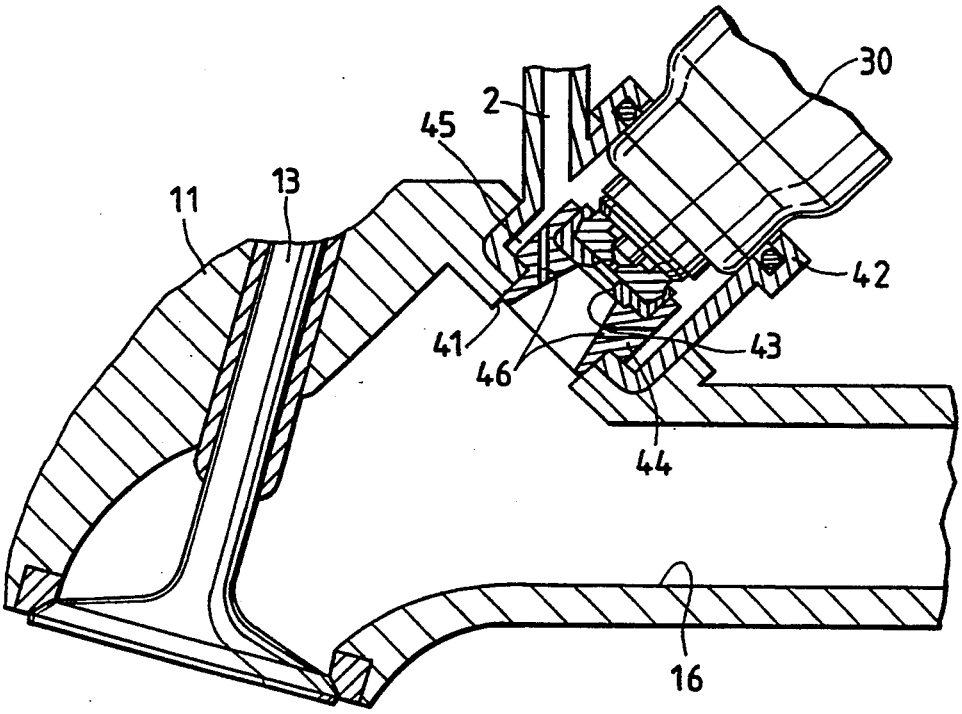
FIG. 2 is a cross-sectional view which shows a fuel injection valve and an intake air port of each cylinder of the engine.

FIG. 2 shows arrangements of installation of the fuel injection valve 30 into the intake port 16 and a portion around an injection nozzle 43 of the fuel injection valve 30.

The fuel injection valve 30, as can be seen in the drawing, is inserted into a cup-shaped socket 42 and hermetically sealed with an O-ring. The socket 42 is mounted in an opening 41 of the intake port 16. The top end of the fuel injection valve 30 forms the injection nozzle 43 which is inserted into a smaller socket 44 pressed into the opening 41. The end of the branch air mixture line 2 is communicated with a space, or chamber 45 defined by an inner wall of the socket 42, the socket 44, and a portion of the fuel injection valve 30 inserted into the socket 42. The chamber 45 is communicated with the opening 41 through a plurality of air nozzles 46 drilled in the socket 44 so that the air in the chamber 45 is ejected into a portion of the intake port 16 around the injection nozzle 43.

The structure of the air control valve 33 will be discussed with reference to FIGS. 3 to 6.

Figure 3:
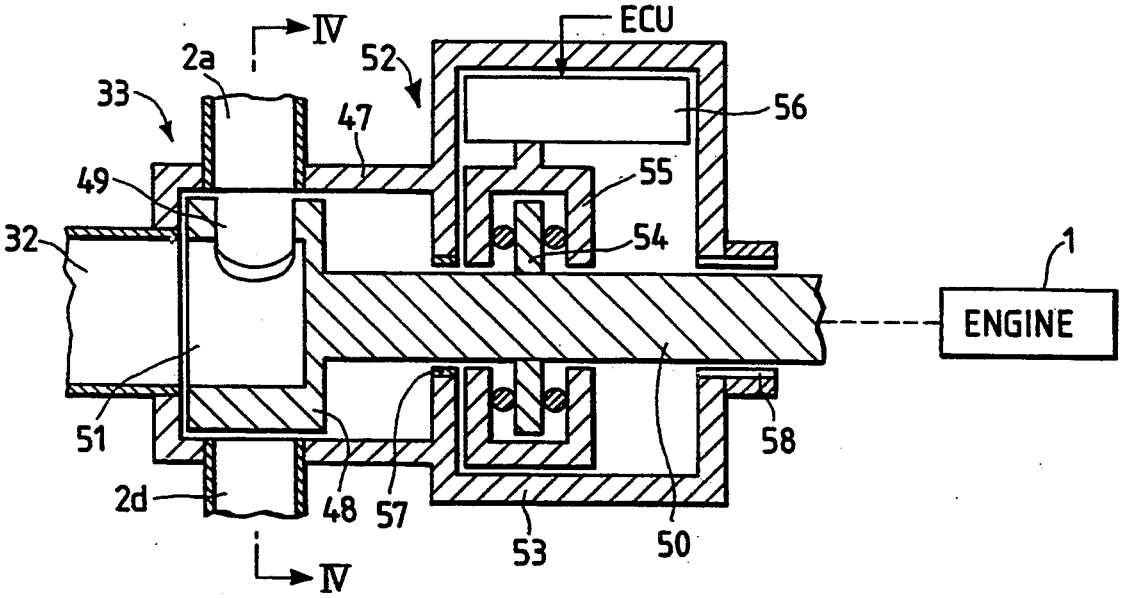
FIG. 3 is a cross-sectional view which shows an air control valve according to the present invention.

FIG. 3 shows the air control valve 33 under normal operating conditions of the engine. The air control valve 33 includes a cylindrical housing 47 and a cylindrical rotor 48. The cylindrical rotor 48 is rotatably disposed within the housing 47 and is also supported slidably in a direction parallel to a rotational axis thereof. A gap defined between an inner surface of the cylindrical housing 47 and an outer surface of the rotor 48 is sealed to an extent which allows the rotor 48 to rotate and slide along the rotational axis thereof. In the rotor 48, an arc-like opening 49 which ranges over a circumferential surface of about 90° is formed. The rotor 48 is driven according to the speed of the engine. In case of a four cycle engine, the rotor 48 is connected through an input shaft 50 attached to the bottom of the rotor to a cam shaft (not shown) of the engine 1 which drives the intake valve 13 and the exhaust valve 14, and is rotated in synchronism with the cam shaft.

Figure 4:
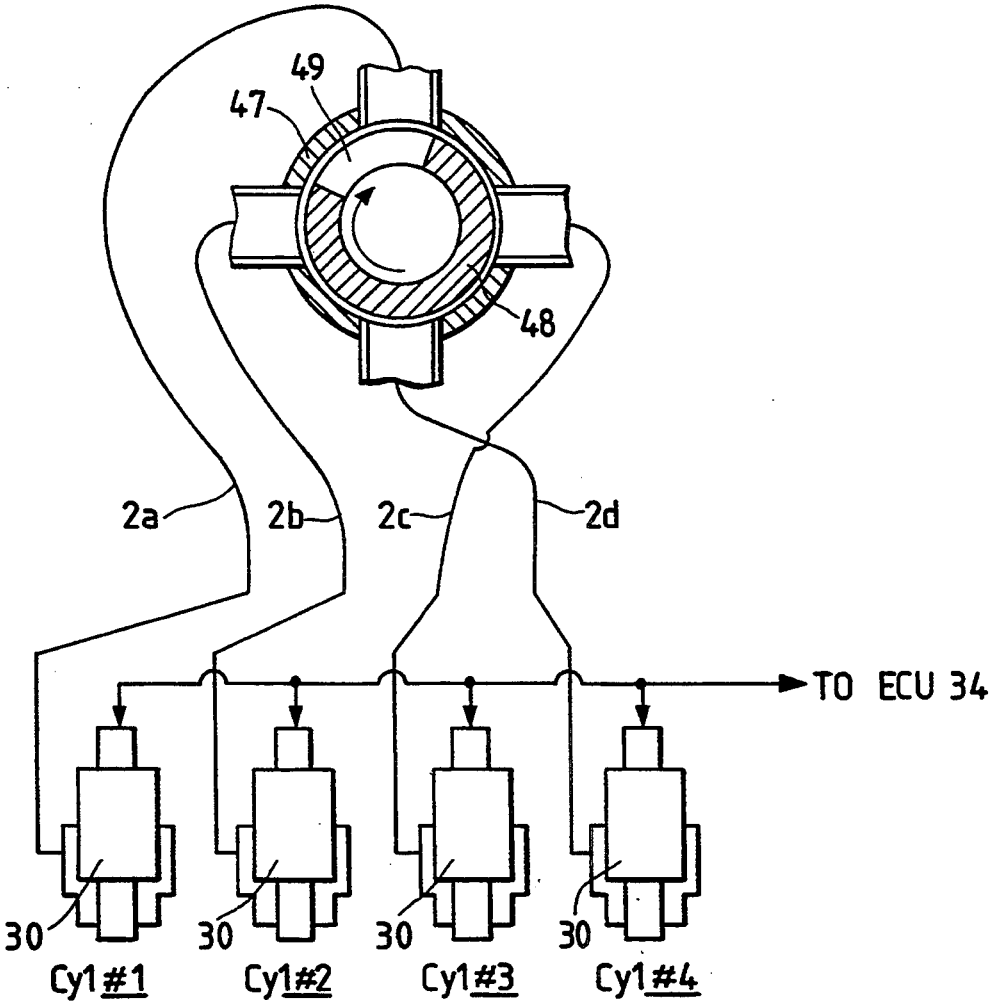
FIG. 4 is a cross-sectional view which shows connections between branch air mixture lines each leading to an intake port of each cylinder and an air mixture line connected to a portion of an intake air passage upstream of a throttle valve.

The air control valve 33 shown is designed for a four-cycle four-cylinder engine. Therefore, four air outlet ports are, as shown in FIG. 4, formed in a circumferential surface of the cylindrical housing 47 at regular intervals of 90° which communicate with the branch air mixture lines 2*a*, 2*b*, 2*c*, and 2*d*, respectively. The rotor 48 includes therein a chamber 51 leading to the air mixture line 32 which is, in turn, connected to the portion of the air intake passage 20 upstream of the throttle valve 21 so that a portion of intake air measured by the airflow meter 22 is introduced into the air control valve 33.

Attached to the housing 47 of the air control valve 33 is a cylindrical housing 53 of a control mechanism 52. In the housing 53, a disk 54 is attached to the input shaft 50 of the rotor 48 and is rotatably supported by a bearing portion 55 including a pair of thrust bearings engaging both surfaces of the disk 54. The bearing portion 55 is supported slidably in an axial direction by a bearing actuator 56. Dry bearings 57 and 58 are mounted in openings of the cylindrical housing 53 for rotatably supporting the input shaft 50. It is desirable that the bearing 57 have an air tight seal.

Figure 5:
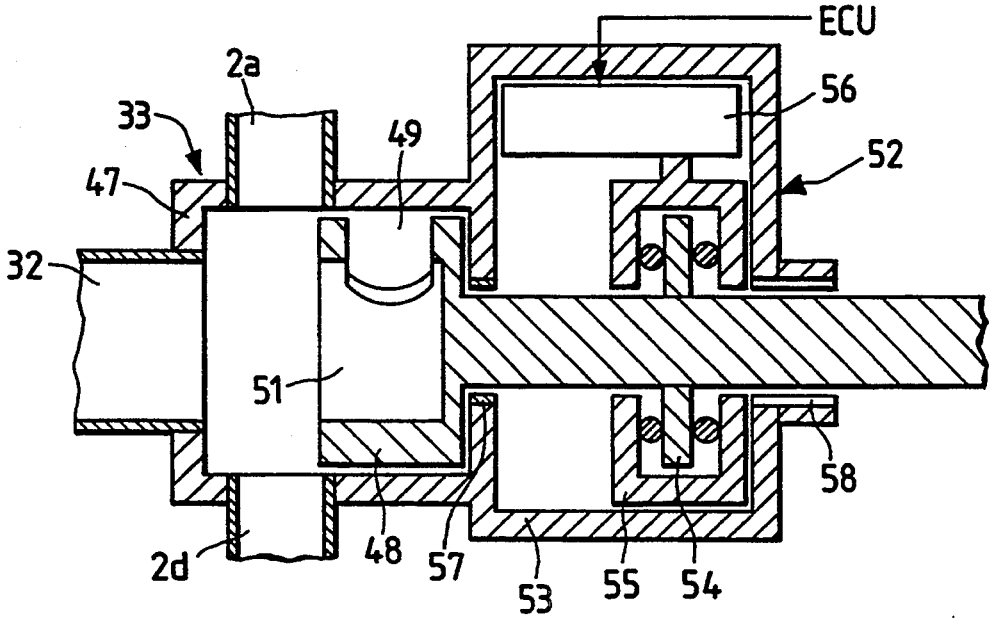
FIG. 5 is a cross-sectional view which shows an air control valve according to the present invention when a rotor is urged to a position which establishes communication between all branch air mixture lines each leading to an intake port of each cylinder and an air mixture line connected to a portion of an intake air passage upstream of a throttle valve.

The bearing actuator 56 of the control mechanism 52 is responsive to a control signal from the ECU 34 to produce a thrust under electromagnetic force, air pressure, or hydraulic pressure enough to shift the rotor 48 through the bearing portion 55, the disk 54, and the input shaft 50 in the axial direction between a position, as shown in FIG. 3, where the opening 49 of the rotor 48 establishes fluid communications between the air mixture line 32 and the branch air mixture lines 2*a*, 2*b*, 2*c*, and 2*d* in sequence according to the rotation of the rotor 48 (hereinafter, this condition will be referred to as "sequential distribution mode") to a position, as shown in FIG. 5, where the opening 49 moves out of registry with all the branch air mixture lines 2*a*, 2*b*, 2*c*, and 2*d* so that they communicate with the air mixture line 32 completely to allow air to flow uniformly from the air mixture line 32 to the branch air mixture lines 2*a*, 2*b*, 2*c*, and 2*d* (hereinafter, this condition will be referred to as "fully open mode").

Figure 6:
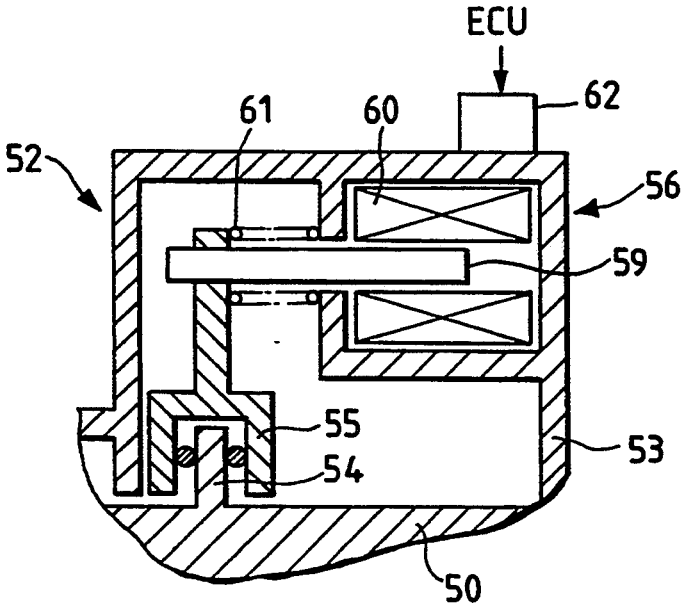
FIG. 6 is a cross-sectional view which shows a solenoid-operated actuator which shifts a rotor of an air control valve in an axial direction thereof.

FIG. 6 shows an example of the bearing actuator 56 which produces an electromagnetic force for moving the rotor 48 in the axial direction. The bearing actuator 56 includes a ferromagnetic core member 59, a solenoid 60, a coil spring 61, and a connector 62 connecting between the ECU 34 and the solenoid 60. The ferromagnetic core member 59 is attached at an end thereof to the bearing portion 55 at right angles, while the other end thereof is inserted into the solenoid 60. The coil spring 61 is arranged between the bearing portion 55 and the solenoid 60 to urge the bearing portion into constant engagement with the inner wall of the housing 53 so that the rotor 48 may assume the position, as shown in FIG. 3, in the sequential distribution mode. Upon energization of the solenoid 60, the core member 59 is drawn toward the solenoid 60 so that the rotor 48 is shifted through the bearing portion 55 and the input shaft 50 to assume the position, as shown in FIG. 5, in the fully open mode.

With the above arrangements, when the engine 1 is in operation, the ECU 34 provides a control signal to the fuel injection valve 30 of each cylinder intermittently so that the fuel pressurized by the fuel pump 29 is injected into the intake port 16. When a large amount of intake air flows in the intake port 16, it will cause the injected fuel to be atomized easily. However, when the engine is operating at a lower load level, for example, during idle modes of engine operation, only a small amount of intake air flows through the intake port 16 at a relatively lower flow velocity. The injected fuel, therefore, enters the combustion chamber 12 while not being atomized sufficiently with the result that it may not be burnt completely to produce in the exhaust pipe 24 an exhaust gas containing a large amount of harmful emission products such as HC or CO.

When the engine falls in a lower load rage wherein the throttle valve is almost closed, the pressure in the intake port 16 becomes lower than that in the air intake passage 20 upstream of the throttle valve 21 to produce a pressure difference which will cause a portion of the intake air in the air intake passage 20 to be drawn into the intake port 16 through the air mixture line 32 and the branch air mixture line 2.

Figure 8:
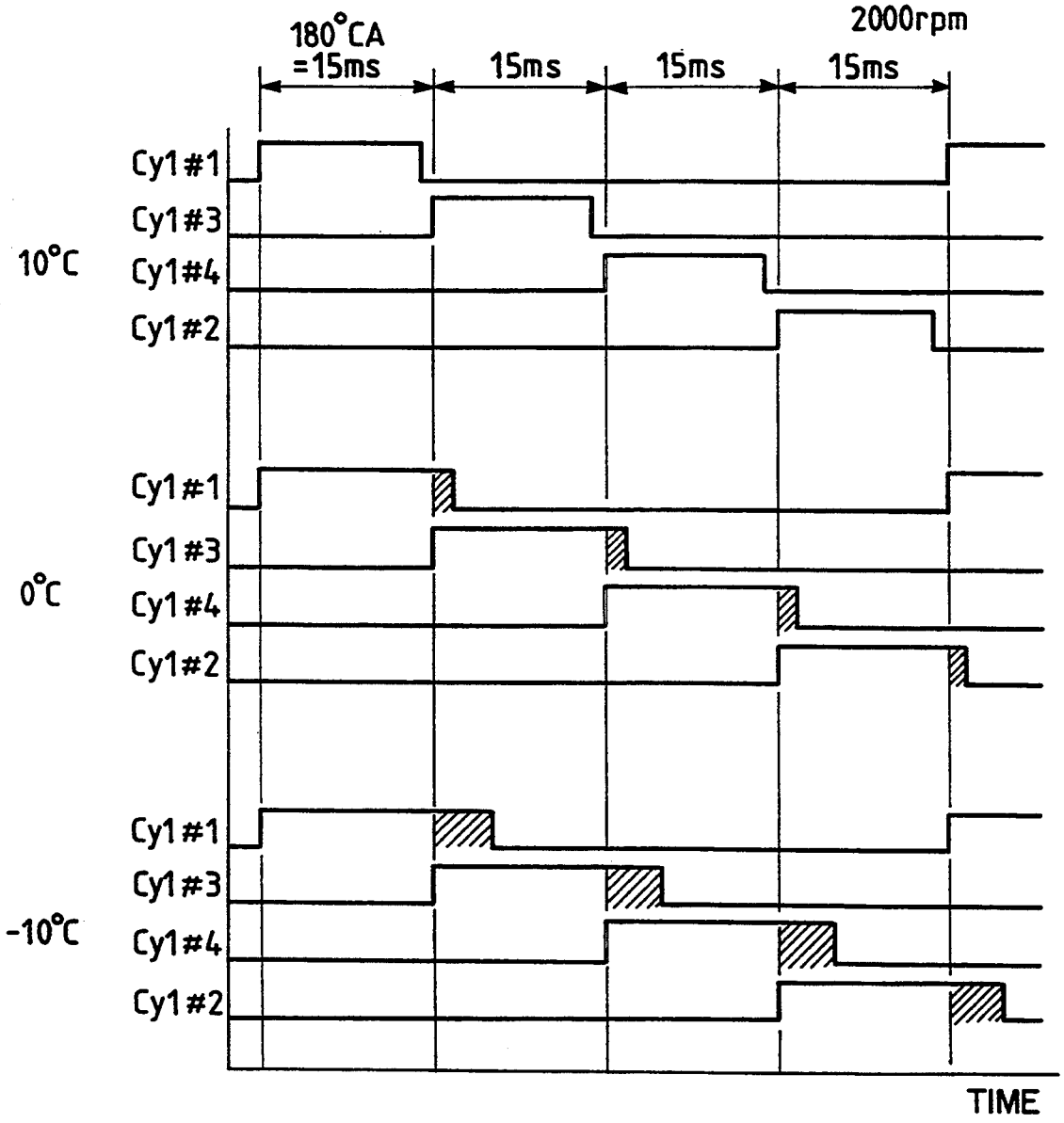
FIG. 8 is a graph which shows relations of fuel injection time periods fuel injection valves are open among cylinders 1#, 3#, #4, and #2 of a four-cylinder engine.

As shown in FIG. 8, when the engine starts at a relatively higher temperature of 10° C. in the combustion chamber 12, the ECU 34 deactivates the control mechanism 52 of the air control valve 33 so that the rotor 48 is, as shown in FIG. 6, urged by the spring 61 to assume the position, as shown in FIG. 3, wherein it rotates through the input shaft 50 in synchronism with the cam shaft of the engine 1 to establish the sequential distribution mode which allows the air control valve 33 to distribute the intake air in the air mixture line 32 to the branch air mixture lines 2*a*, 2*b*, 2*c*, and 2*d* in sequence at each cycle of 180° CA (crank angle). The intake air distributed into each branch air mixture line then enters the chamber 45 of the fuel injection valve 30 of each cylinder which is, in turn, ejected through the air nozzles 46 to the fuel injected from the injection nozzle 43 of the fuel injection valve 30, thereby facilitating atomization of the injected fuel.

At a lower temperature, for example, 0° C. or −0° C. in the combustion chamber 12, since the volatility of fuel will be degraded according to a decrease in ambient temperature, the amount of fuel injected from the fuel injection valve 30 is corrected by the ECU 34 in a direction of increase in a manner wherein the fuel injection period of time during which the fuel injection valve 30 is open is, as shown by hatched areas in FIG. 8, prolonged beyond 180° CA, resulting in a portion of the fuel injection period of time overlapping with that of another cylinder. At this time, the ECU 34 provides a control signal to the bearing actuator 56 of the control mechanism 52 so that the rotor 48 being rotated in synchronization with the speed of the engine 1 is shifted to the position, as shown in FIG. 5, to establish the fully open mode. Therefore, the air mixture line 32 becomes communicated with all the branch air mixture lines 2*a*, 2*b*, 2*c*, and 2*d* regardless of an angular position of the rotor 48. The intake air in the air mixture line 32 is supplied to the injection nozzles 43 of the fuel injection valves 30 of all cylinders through the branch air mixture lines 2*a*, 2*b*, 2*c*, and 2*d* as long as there is the difference in pressure between the intake port 16 of each cylinder and the air intake passage 20. Accordingly, it will be appreciated that in the hatched areas, as shown in FIG. 8, the atomization of the injected fuel is facilitated effectively.

Figure 7:
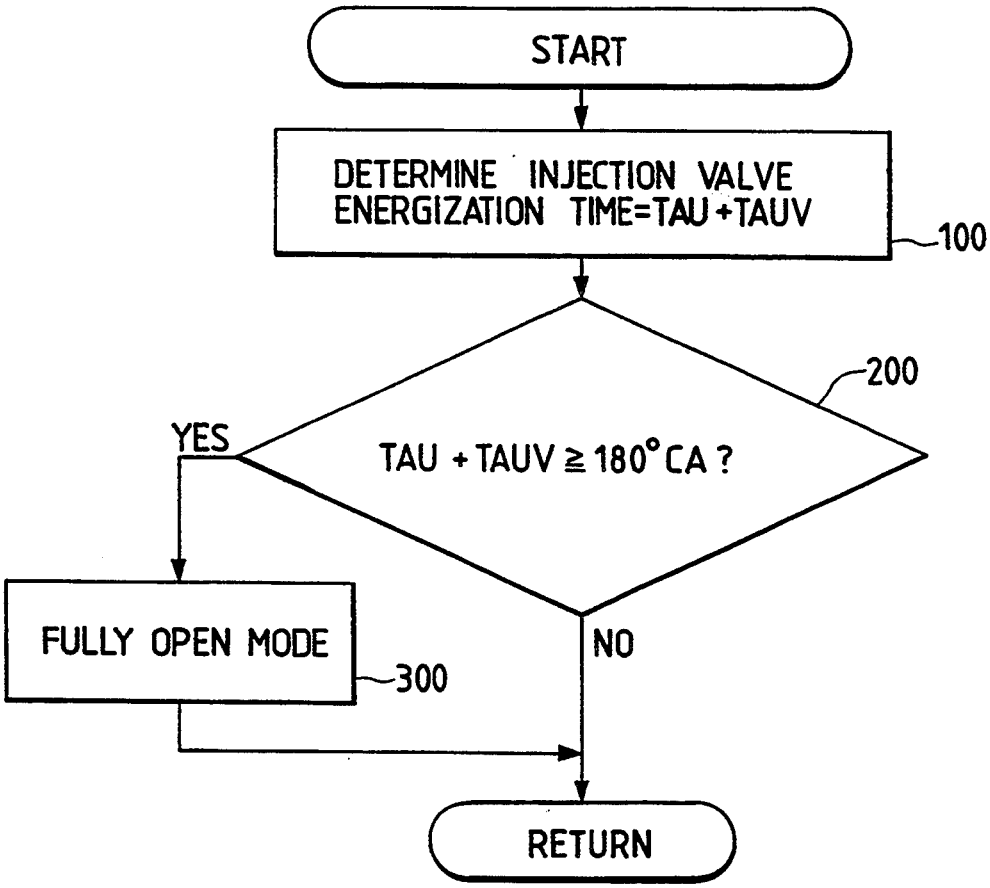
FIG. 7 is a flowchart of a program of sequence or logical steps performed by an electronic control unit of a fuel injection system of the invention.

Referring to FIG. 7, there is shown a flowchart of a program or sequence or logical steps performed by the ECU 34 of the fuel injection system for controlling the operations of the fuel injection valve 30 and the air control valve 33. This program is carried out at preselected intervals, for example, every crank angle of 180° of the engine 1.

After entering the program, the routine proceeds to step 100 wherein the ECU 34 determines the length of time the fuel injection valve 30 is to be opened (i.e., fuel injection period of time) which corresponds to a total amount of fuel required by the engine in the following manner which is well known in the art. A basic fuel injection amount Q/N is initially calculated by dividing the intake air quantity Q measured by the airflow meter 22 by an engine speed Ne monitored by the rotational angle sensor 40. The basic fuel injection amount Q/N is then multiplied by preselected correction coefficients based on factors such as a coolant temperature, an intake air temperature, and an air/fuel ratio which are factors representing operating conditions of the engine to determine a valve opening time TAU of the fuel injection valve 30. Subsequently, using a map prestored in the ROM 34*b*, a dead injection time TAUV is derived which is defined in terms of a voltage level of the battery 34*f*, and is then added to the valve opening time TAU to determine an injection valve energization time (TAU+TAUV) required to derive a desired total amount of fuel injected by the fuel injection valve 30.

The routine then proceeds to step 200 wherein it is determined whether the injection valve energization time (TAU+TAUV) is longer than a period of time corresponding to 180° CA rotation or not. In other words, this determination is made for determining whether a total fuel injection amount is greater than a preselected value or not. If a YES answer is obtained concluding that the injection valve energization time (TAU+TAUV) is longer than the period of time corresponding to 180° CA rotation, the routine then proceeds to step 300 wherein the air control valve 33 is controlled to establish the fully open mode. Alternatively, if a NO answer is obtained in step 200, the routine then returns back to the initial step.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims. For example, though the above embodiment is drawn to a four-cycle four-cylinder engine, the benefits of the present invention may also be applied to a multi-cylinder engine other than a four-cylinder engine such as a four-cycle six-cylinder engine. In this case, the air control valve 33 is controlled to establish the fully open mode when a crank angle CA exceeds 120°.

Additionally, a small capacity air compressor may be arranged in the air mixture line 32 to supply a compressed air to the air control valve 33 for assuring a sufficient amount of intake air to be ejected around the injection nozzle 43 of the fuel injection valve 30 over a wide operating range of the engine.

What is claimed is:

1. A fuel injection system for a multi-cylinder internal combustion engine comprising:

a plurality of fuel injection valves each arranged to inject fuel into an intake port of each cylinder of the engine;

an air passage connected to a portion of an air intake passage leading to the intake ports;

a plurality of branch air passages each communicating with a preselected portion around an injection nozzle of each fuel injection valve;

air control valve means, connecting between said air passage and said plurality of branch air passages, for selectively introducing a portion of intake air in the air intake passage to the preselected portions around the injection nozzles of the fuel injection valves, said air control valve means being arranged to selectively assume first and second valve positions, the first valve position being to establish communications between said air passage and the branch air passages in sequence according to rotation of the engine, the second valve position being to establish communication between said air passage and all the branch air passages; and controlling means for providing a control signal to said air control valve means to switch from the first valve position to the second valve position when a preselected fuel injecting condition is encountered.

2. A fuel injection system as set forth in claim 1, wherein said air control valve means includes a rotary member, said rotary member being arranged to rotate with respect to a rotational axis thereof to establish the first valve position where said air passage communicates with the branch air passages in sequence according to the rotation of the engine and to move in a direction parallel to the rotational axis to establish the second valve position where said air passage communicates with all the branch air passages.

3. A fuel injection system as set forth in claim 2, wherein said controlling means provides the control signal to said air control valve means to move the rotary member in the direction parallel to the rotational axis when a fuel injection amount is greater than a preselected value is required.

4. A fuel injection system as set forth in claim 1, wherein said rotary member is rotated by a rotatable shaft connected to the engine.

5. A fuel injection system as set forth in claim 4, wherein said air control valve means includes an actuator which is responsive to the control signal from said controlling means to shift the rotatable shaft in the direction parallel to the rotational axis of the rotary member when an opening period of time the fuel injection valves are open becomes longer than a preselected value.

6. A fuel injection system as set forth in claim 1, wherein said air control valve means includes a rotary member and a housing, the housing including a plurality of first openings connected to the branch air passages respectively and a second opening connected to said air passage, the rotary member including an opening which is arranged to establish coincidence with at least one of the branch air passages according to the rotation of the engine in the first valve position, the rotary member being shifted in a direction parallel to a rotational axis of the rotary member so that the opening moves out of the coincidence with all the branch air passages in the second valve position.

7. A fuel injection system as set forth in claim 6, wherein said air control valve means includes a rotatable shaft rotatably connecting said rotary member to the engine and a solenoid actuator which is responsive to the control signal from the controlling means to produce a thrust which urges said rotary member from the first valve position to the second valve position.

8. A fuel injection system as set forth in claim 6, wherein the housing is provided with a cylindrical member which forms therein the first openings at regular intervals, the opening of the rotary member ranging over a preselected circumference of the rotary member to establish the communication between at least one of the branch air passages and said air passage.

* * * * *